United States Patent [19]

Brody

[11] 4,180,958

[45] Jan. 1, 1980

[54] METHOD AND APPARATUS FOR FASTENING OBJECT TO CLAY TILE ROOF

[76] Inventor: Kenneth I. Brody, 2492 Banyon Dr., Los Angeles, Calif. 90049

[21] Appl. No.: 855,781

[22] Filed: Nov. 25, 1977

[51] Int. Cl.[2] ..... E04D 1/00

[52] U.S. Cl. ..... 52/747; 52/741; 52/698

[58] Field of Search ..... 52/27, 741, 698, 467, 52/521, 549, 747; 248/237, 148; 85/3 R

[56] References Cited

U.S. PATENT DOCUMENTS

| | | | |
|---|---|---|---|
| 1,672,629 | 6/1928 | Stuckert | 52/467 X |
| 2,604,194 | 7/1952 | Hammitt et al. | 52/549 X |
| 3,057,119 | 10/1962 | Kessler | 52/741 |
| 3,277,623 | 10/1966 | Fischer | 52/549 X |
| 3,389,631 | 6/1968 | Vaillancourt | 85/3 R |
| 3,999,339 | 12/1976 | Sappenfield | 52/741 X |

*Primary Examiner*—Carl D. Friedman
*Attorney, Agent, or Firm*—Freilich, Hornbaker, Wasserman, Rosen & Fernandez

[57] ABSTRACT

A method and apparatus for fastening an object, such as a board to which another object may be fastened, to a clay tile roof utilizes rod threaded at both ends with a wing expansion nut on one end that is passed through a hole drilled in the tile and supporting wood at a wing point where the tile rests on the wood. A rubber washer backed by a metal washer and nut seals the hole in the clay tile and secures the rod in an upright position. A washer and second nut at the other end of the rod then secures the object to the roof with the object spanning the ridge points of two or more tiles. A third nut locks the second nut on the rod, and allows the rod to be turned like a bolt to drive the excess rod into the roof. To facilitate installation, the rod is preferrably threaded from end to end.

5 Claims, 2 Drawing Figures

METHOD AND APPARATUS FOR FASTENING OBJECT TO CLAY TILE ROOF

BACKGROUND OF THE INVENTION

This invention relates to a method and apparatus for fastening an object, or objects, to a clay tile roof.

For many years it has been customary to fasten radio and television antennas to a roof, usually by fastening the end of a pole to a plate, and steading the pole with guys. The problem has been with fastening the plate and guys to a clay tile roof. Now it has become necessary to also fasten solar heating devices, such as hollow plastic panels through which water circulates for heating with solar energy. The problem of fastening to a corrugated clay tile roof is much greater for solar heating devices because they are by their very nature large and are required to be fastened to the roof at more than one point.

The problem with fastening an object to a clay tile roof is that the clay tile will easily crack or break if placed under any great stress. Clay tile will withstand relatively high and static compressive stress, but hardly any other kind of stress. An object of this invention is to provide an improved method and apparatus for fastening to a corrugated clay tile roof.

SUMMARY OF THE INVENTION

In accordance with the present invention, a hole is drilled through a corrugated clay tile and its supporting wood at a valley point where the tile is resting on the wood. A wing expansion nut threaded on the end of a rod is then inserted through the hole. Once the expansion nut passes through the hole in the clay tile and wood, it expands so that the tile may be placed under compressive stress by a first nut threaded on the rod. A rubber washer covered by a metal washer is placed between the first nut and the clay tile to seal the hole in the clay tile, thus securing the rod to the roof. In an upright position an object spanning two or more tile ridge points may then be placed with a hole through it over the rod. The object is then secured with a washer and a second nut threaded on the upper end of the rod. The second nut is tightened only until the object is held firm against the tile with substantially no tension on the rod so as not to stress the tile. A third nut is then threaded on the rod over the second nut and tightened to put the rod between the second and third nut under tension, thus locking the second and third nuts in place on the rod. During installation, the second and third nuts may be thus locked on the upper extreme end of the rod in order to turn the nuts with the rod and thus drive any excess rod through the expansion nut and the first nut into the roof. Alternatively, a capped nut may be threaded on the end of the rod and used to drive the excess rod into the roof until the capped nut secures the object firmly on the tile. In that manner two locked nuts or a single capped nut may be used as means threaded on the upper end of the rod to drive the rod in and secure the object firmly on the tile.

The novel features of the invention are set forth with particularity in the appended claims. The invention will best be understood from the following description when read in conjunction with the accompanying drawings.

DESCRIPTION OF PREFERRED EMBODIMENTS

Figure 1:
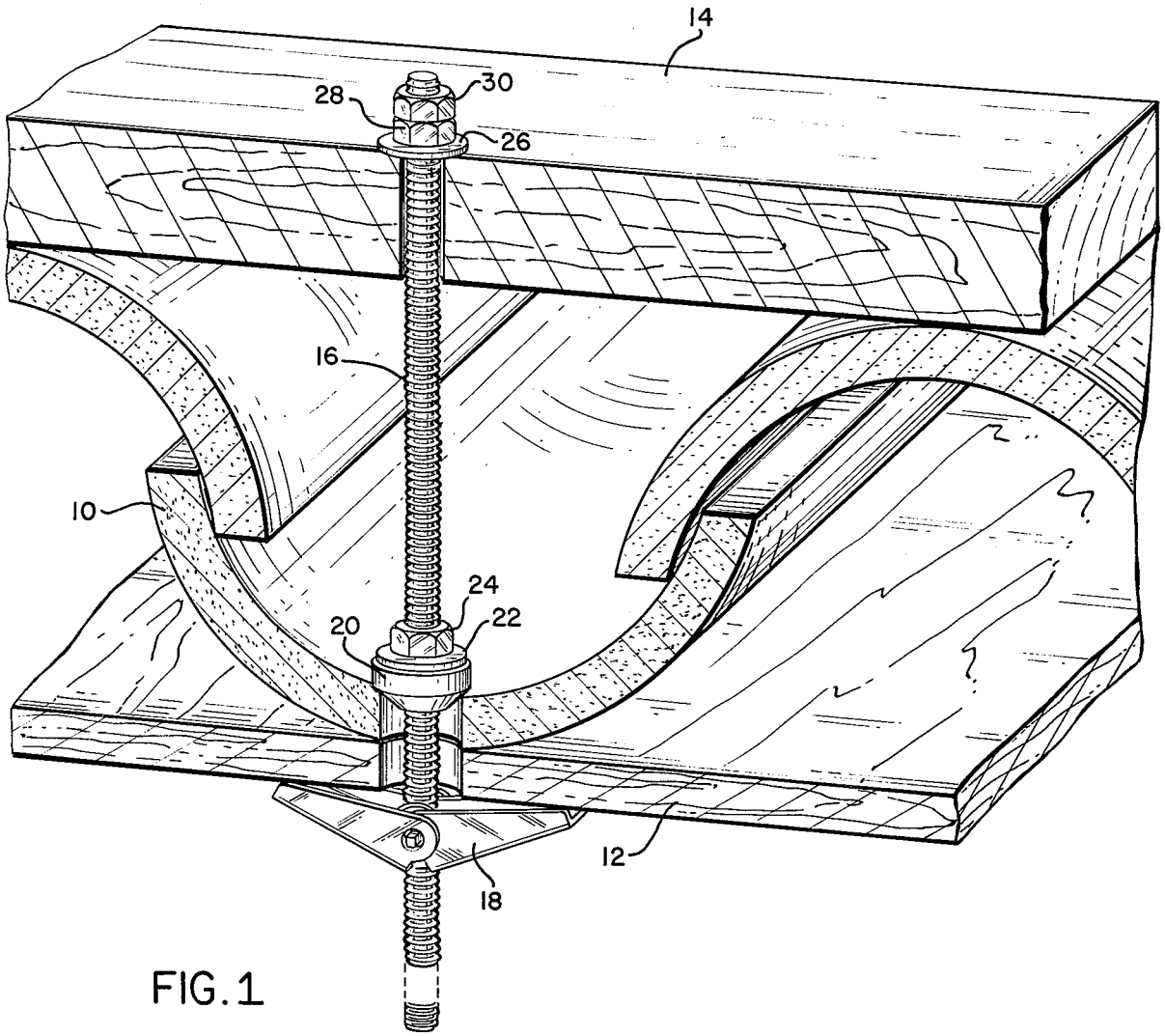
FIG. 1 is an isometric view illustrating the present invention.

Referring now to FIG. 1, a portion of a corrugated clay tile roof is shown with a tile 10 resting on a plywood sheet or board 12, referred to hereinafter as simply supporting wood. A suitable roofing paper (not shown) is spread over the supporting wood as a moisture barrier before the clay roof is laid down.

To secure an object to the roof, such as board 14 to which another object may be secured, such as a solar heating panel, a hole is first drilled through the tile and supporting wood at a point where the tile rests on the supporting wood as shown.

A rod threaded at both ends, and preferably threaded from end to end, is prepared with expansion nut 18, rubber washer 20, metal washer 22 and nut 24 on one end. Then, the rod and wing expansion nut are inserted through the hole in the tile 10 and supporting wood 12 until the expansion nut expands.

The nut 18 is of a conventional type having two wings which fold up against a spring to allow it to pass through the hole. The spring then causes the wings to unfold. Once the rod is pulled up with light tension, the wings embed themselves in the supporting wood 12. The nut 24 may then be turned to compress the rubber washer 20 between the metal washer 22 and the tile to seal the hole in the tile. For a good seal, the rubber washer 20, not only has an outside diameter greater than the hole in the tile, but also has an inside diameter substantially less then the diameter of the rod to seal around the threads. Once the nut 24 is tightened to place the rubber washer 20 under compression, and the lower end of the rod under slight tension, the rod is secure in an upright position with the tile under only slight compressive stress.

The board 14, or other object that spans the ridges of two or more tiles, and which has a mounting hole 25 for securing it to the roof, is then placed on the roof with its hole over the rod. A metal washer 26 and a nut 28 are then placed over the rod and tightened to secure the board 14 on the roof tile, but without placing large tension on the rod 16. The amount of tension, if any, that may be placed on the rod will depend upon the rigidity of the board or other object being fastened, and to the number of tiles that the board or object spans. However, it is not necessary to place the rod under any but the most minimal tension to secure the object firmly to the roof. Moreover, to avoid placing any stress on the tile upon tightening the nut 28, a metal or plastic tube could be placed over the rod to fit between the washer 22 and the underside of the board 14. A metal washer would then be placed between the upper end of the tube and the board. However, the task would then be to cut a piece of tube of the proper length so that the board 14 will rest with its weight on the ridges of the tile roof in order to distribute its weight over a plurality of tiles. It has been found that such a tube can be dispensed within most cases, provided care is taken not to tighten the nut 28 so much as to overstress the tile on either side of the rod.

Any wind that may tend to lift the object from the roof will place some tension on the rod, but that tension will exert a force on only the wood 12, and not stress the tile on the roof. The weight of the object, and any wind force on the object in the same direction as the weight will be evenly distributed over the tiles on which the wood 14 rests.

Figure 2:
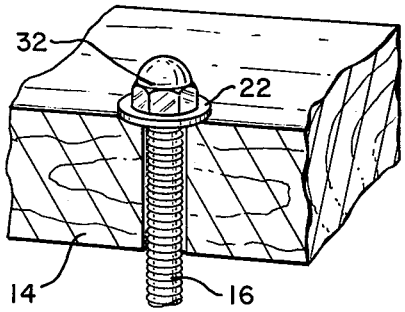
FIG. 2 illustrates a variant of the present invention.

To lock the second nut 28 in place, a third nut 30 is placed over the second nut and tightened against the second nut. In order that any excess length of all-thread rod be inside the roof, and not project up more than a few turns of thread, as shown, the object may be placed on the roof with its hole over the rod 16 to determine the excess length of rod. The excess may then be screwed into the expansion nut 18 and the first nut 24 by first locking the second nut on the upper end of the rod with the third nut, and then turning the second nut and third nut with the rod like a bolt to thread the excess rod into the roof after the first nut 24 and washer 22 are first tightened firmly against the tile. Alternatively, a capped nut 32 may be threaded over the upper end of the rod, as shown in FIG. 2, in order to turn the rod like a bolt until the nut 32 and washer 22 are firmly against the object being fastened to the roof, which is the board 14 in this illustration.

Although particular embodiments of the invention have been described and illustrated herein, it is recognized that modifications and variations may readily occur to those skilled in the art. It is therefore intended that the claims be interpreted to cover such modifications and variations.

What is claimed is:

1. A method for fastening an object having a fastening hole to a corrugated clay tile roof utilizing a rod, threaded over at least a substantial portion at both ends, with a wing expansion nut at one end comprising the steps of: drilling a hole through said tile at a valley point where said tile rests on supporting wood; inserting said expansion nut through said hole sufficiently for its wings to expand, thus preventing the expansion nut threaded on the end of the bar from being pulled out of said hole; placing a washer of resilient material on said rod over the drilled hole in said tile, placing a first rigid washer on said rod over said resilient washer, and threading a first nut on said rod over said washer to press said resilient washer against the hole in said tile thereby to seal the hole in said tile around said rod; placing said object on said roof with the object spanning the ridges of two or more tiles for support so that said rod protrudes through said fastening hole in said object; placing a second washer of nonresilient material on said rod over said object; and threading a second nut on said rod over said second washer of resilient material to fasten said object on said roof.

2. The method of claim 1 wherein said second nut is threaded on said rod only slightly below its upper end, including the steps of threading a third nut on said rod over said second nut, and tightening said third nut against said second nut to lock the two together, and tightening said second nut against said last washer to tighten said object on said roof against said supporting tile by turning said second and third nuts as one to turn said rods in the threads of said expansion nut and said first nut, thereby to tighten said object on said roof while threading excess length of said rod down below supporting wood for said tile.

3. The method of claim 1 wherein said second nut is a capped nut, whereby tightening said second nut on the upper end of said rod permits said rod to be driven into said roof by turning it from the second nut like a bolt.

4. A method for fastening an object having a fastening hole to a corrugated clay tile roof utilizing a rod, threaded over at least a substantial portion at both ends, with a wing expansion nut threaded on one end with a resilient washer, rigid washer and a first nut, spaced behind it, and in that order, comprising the steps of: drilling a hole through said tile at a valley point; inserting said expansion nut through said hole sufficiently for it to expand, thus preventing the expansion nut threaded on the end of the bar from being pulled out of said hole; pressing said washer of resilient material over the drilled hole in said tile, by tightening said first nut on said rod over said rigid washer, thereby to press said resilient washer against the tile around said hole, thereby to seal the hole in said tile around said rod; placing said object on said roof with the object spanning ridge points of two or more tiles for support so that said rod protrudes through said fastening hole in said object; placing a second washer of nonresilient material on said rod over said object; and threading a second nut on said rod over said second washer of resilient material to fasten said object on said roof.

5. The method of claim 4 including the steps of threading a third nut on said rod over said second nut, and tightening said third nut against said second nut to lock the two together, and tightening said second nut against said last washer to tighten said object on said roof against said supporting tile by turning said second and third nuts as one to turn said rod in the threads of said expansion nut and said first nut, thereby to tighten said object on said roof while threading excess length of said rod down below supporting wood for said tile.

* * * * *